United States Patent [19]

Robinson

[11] 4,006,793

[45] Feb. 8, 1977

[54] ENGINE MUFFLER APPARATUS PROVIDING ACOUSTIC SILENCER

[76] Inventor: Joseph D. Robinson, 1209 159th St., Gardena, Calif. 90247

[22] Filed: Nov. 14, 1975

[21] Appl. No.: 631,866

[52] U.S. Cl. ..... 181/53; 181/54; 181/57

[51] Int. Cl.[2] ..... F01N 1/08

[58] Field of Search ..... 181/53, 54, 57, 58, 181/59, 49

[56] References Cited

UNITED STATES PATENTS

| | | | |
|---|---|---|---|
| 2,287,412 | 6/1942 | Bourne | 181/53 |
| 2,326,613 | 8/1943 | Bourne et al. | 181/53 |
| 2,993,559 | 7/1961 | Bohannan | 181/53 |
| 3,127,951 | 4/1964 | Pierce | 181/54 |
| 3,581,842 | 6/1971 | Hall | 181/54 |
| 3,724,591 | 4/1973 | Malkiewicz | 181/53 |
| 3,786,896 | 1/1974 | Foster et al. | 181/53 |
| 3,887,032 | 6/1975 | Harris | 181/59 |

*Primary Examiner*—Stephen J. Tomsky
*Attorney, Agent, or Firm*—Henry M. Bissell

[57] ABSTRACT

A high efficiency, compact muffler apparatus for use with internal combustion engines comprises a tubular muffler housing internally divided into first, second and third longitudinal chambers by first and second transverse wall partitions. An exhaust inlet duct base axially through the upstream housing end into the first chamber and an exhaust outlet duct extends axially through the downstream housing end through the third chamber to the downstream side of the second partition. A pair of diametrically spaced, internal ducts, open at both ends, project longitudinally, out of alignment with the inlet and outlet ducts, through the two wall partitions from the first chamber, wherein upstream duct ends overlap the inlet duct, through the second chamber and into the third chamber. Several longitudinal, opposing rows of small tubular, aperture-defining elements project from each of the internal ducts in the region of the second chamber. A third transverse wall partition, disposed in the first chamber, creates a small fourth chamber between the first and second chambers; large openings are formed in side-walls of the internal ducts within such fourth chamber. Three longitudinally spaced and opposing pairs of short inlet tubes project laterally from portions of the exhaust duct in the third chamber, downstream of the downstream ends of the internal ducts. The muffler housing may be cast or molded in segmented form from a non-ferrous metal such as aluminum and may include longitudinal cooling fins, or may be formed of corrosion resistant sheet metal. Within the muffler the exhaust gases and sound waves are separated, the sound waves being substantially attenuated in the various chambers. A variation utilizing a somewhat different internal construction is also described.

28 Claims, 9 Drawing Figures

ENGINE MUFFLER APPARATUS PROVIDING ACOUSTIC SILENCER

BACKGROUND OF THE INVENTION

1. Field of the Invention

The invention relates to apparatus for acoustically treating sinusoidal and/or random noise as may be emitted by an internal combustion engine or other sources which emit noise through a valve port or other restricted venting or exhausting aperture, and, more particularly, to mufflers for automobiles and the like.

2. Discussion of the Prior Art

Because the majority of sound or noise supression apparatus, which may generally be referred to as mufflers, is associated with internal combustion engines, this category of application is particularly addressed. Muffler designs are generally of two basic types or configurations: (1) a compartmentalized type which comprises several compartments sealed except for the inlets and outlets, the compartments usually being sealed, noise entrapment chambers; and (2) a type commonly known as a "straight through" buffer, that comprises a perforated duct within a sealed housing. Other mufflers are generally variations of these two basic types.

The first, compartmentalized type muffler has the disadvantages of complexity, large volume requirements for expansion of the gases, and a large size to enclose the compartments. Due to their complexity, such type mufflers create a substantial pressure drop and thus exert substantial back pressure against the exhaust source, thereby reducing engine efficiency. The second straight through -type muffler, although of less complex structure and producing lower back pressure than the first mentioned type, does not provide sufficient noise suppression to be generally acceptable.

A further disadvantage of heretofore known muffler configurations has been the inability to economically manufacture such mufflers so that they will withstand the corrosive road salt (calcium chloride) placed on icy roads in the winter; known muffler housings quickly corrode through from repeated exposure to such salt.

SUMMARY OF THE INVENTION

A high efficiency, compact exhaust muffler in accordance with the present invention generally comprises an elongate tubular housing longitudinally and internally divided by first and second transverse wall means into a first, upstream chamber, a second, central chamber and a third, downstream chamber. An exhaust inlet duct extends through the upstream end of the housing into the first chamber, such duct having open upstream and downstream ends. An exhaust outlet duct extends through the downstream end of the housing into the third chamber, the outlet duct having an open downstream end and having at least one inlet opening formed in an upstream portion disposed in the third chamber. At least one elongate, internal duct is longitudinally disposed within the housing in laterally spaced relationship and out of alignment with the inlet and outlet ducts, such duct being open at both ends and extending through the first and second wall means into the first and third chambers and through the second chamber. The upstream end of the internal duct is positioned upstream of the downstream end of the exhaust inlet duct and the downstream end of the internal duct is positioned downstream from the upstream end of the exhaust outlet duct. The internal duct includes means for defining a number of apertures in side portions thereof which are disposed within the second, central chamber. Sides of the internal ducts in regions of the apertures are outwardly expanded to form short aperture-defining tubular projections, these projections being arranged in rows on opposite sides of the ducts.

More specifically, the exhaust outlet duct extends upstream to the second wall means to which it is attached. Connected to portions of the exhaust outlet duct having an oval or elliptical cross section in the third chamber are at least one pair of short exhaust inlet tubes through which exhaust gases may enter the exhaust outlet duct and which are laterally aligned at opposite sides of the exhaust outlet duct. The most upstream of such lateral tubes are downstream of the downstream end of the internal ducts (two of which are employed) and inlet ends of the lateral tubes are 90° out of alignment with the internal ducts. A third transverse wall means is disposed within the first chamber to form a short fourth chamber between the third and first wall means. Side openings are formed in the internal ducts in the region of the fourth chamber, such openings being directed tangentially toward the inside of the housing and in a generally common circular direction.

In a first variation, the third wall means is omitted as are side openings in the internal ducts associated with the fourth chamber. The upstream end of the exhaust outlet duct is open and the short lateral tubes are eliminated. A baffle panel is installed centrally in the third chamber, dividing the third chamber into upstream and downstream sub-chambers of approximately equal volume. The secnd wall means at the upstream end of the third chamber, as well as being at the upstream end of the upstream sub-chamber, is formed of two closely spaced, transverse wall members through which a resonator tube is disposed into the second chamber, the resonator being open at both ends. Small apertures are formed in the downstream wall member, the wall being expanded in an upstream direction in the region of such apertures to form aperture-defining tubular projections. Large diameter apertures are formed in the baffle panel dividing the third chamber, in general alignment with the internal ducts, which terminate upstream of the panel. A number of small apertures are also formed in a panel, which is expanded in the region of the apertures to form downstream directed tubular-aperture-defining projections.

The housing may be formed of welded, corrosion resistant sheet metal or may be molded or cast from a non-ferrous metal such as aluminum. Inner portions of the muffler are assembled as a core assembly and slipped into the housing before completely assembling the housing.

Within the muffler apparatus, the sound waves are effectively and efficiently separated from the flow of exhaust gas and are substantially attenuated in the various chambers, the muffler being constructed to minimize back pressure which would reduce efficiency of the engine with which the muffler apparatus is used. Because of its efficient acoustical design, the mufflers are only about one-third to one-half the volumetric size of other mufflers of comparative performance.

BRIEF DESCRIPTION OF THE DRAWINGS

A better understanding of the present invention may be had from a consideration of the following detailed description, taken in conjunction with the accompanying drawings in which.

DESCRIPTION OF THE PREFERRED EMBODIMENT

Figure 1:
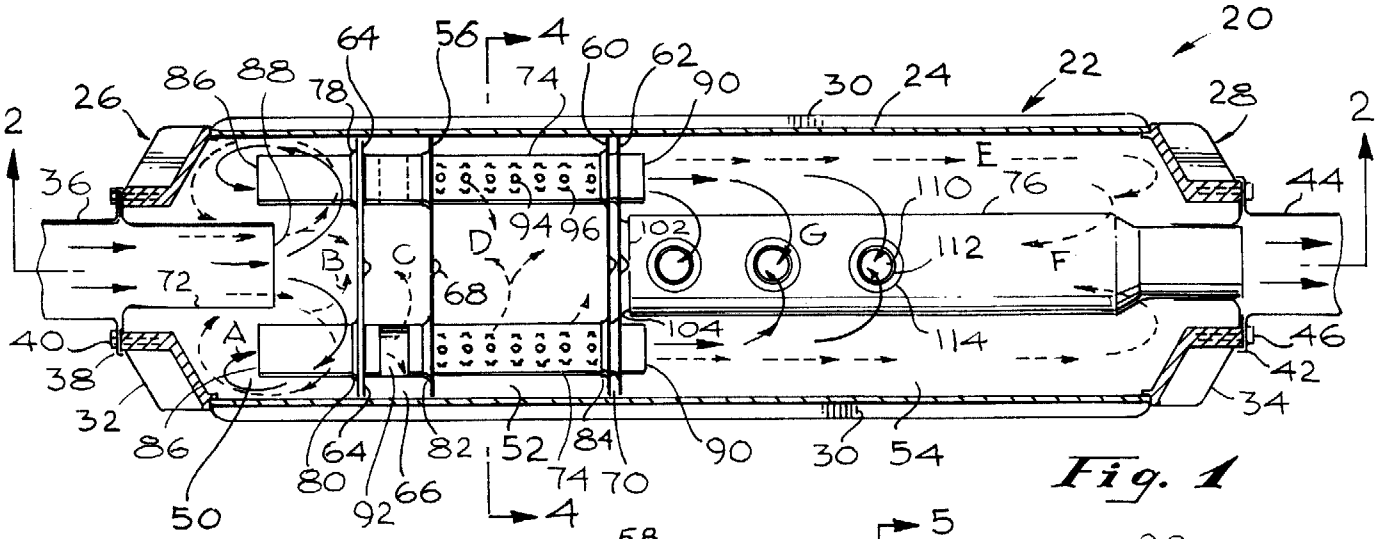
FIG. 1 is a plan view, in section, of one particular arrangement in accordance with the invention.
Figure 2:
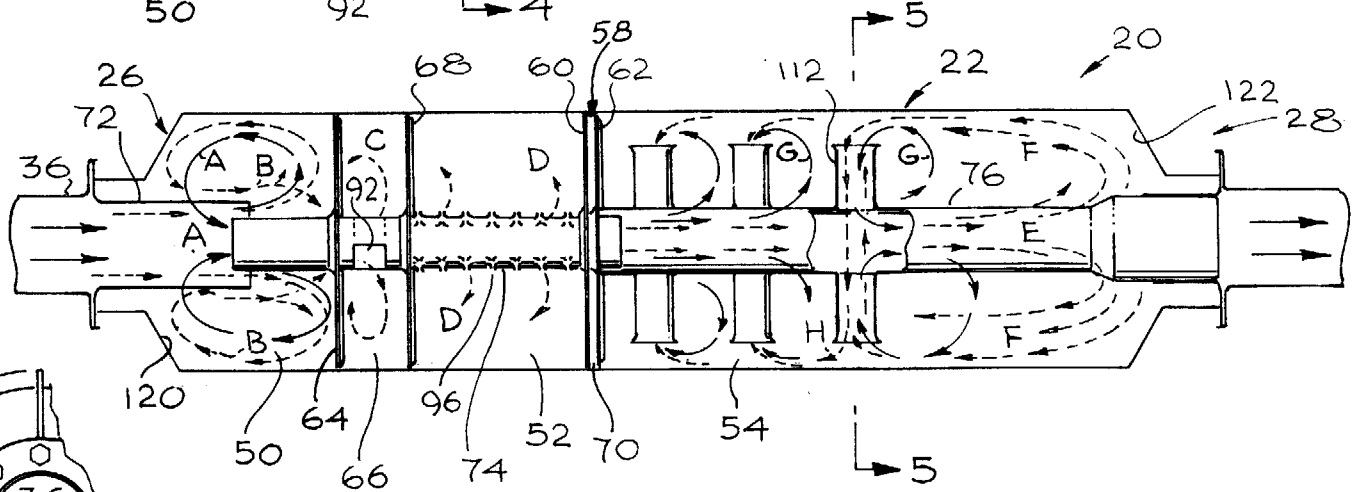
FIG. 2 is a side elevational view, in section, taken along line 2—2 of the arrangement of FIG. 1.
Figure 3:
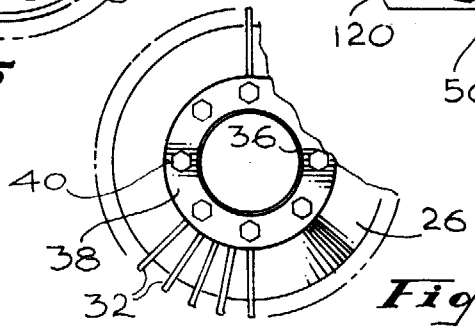
FIG. 3 is an end view of the arrangement of FIG. 1, taken from the left-hand end.

Noise comprises pressure fluctuation waves travelling within a carrier medium from which the noise may be separated; for example, with an exhaust system, the gas flow may be acoustically treated and the noise "separated" therefrom. To this end, and as best seen in FIGS. 1 and 2, a high efficiency, compact silencing apparatus or muffler 20 is constructed in which low frequency, high amplitude pressure fluctuation waves are concentrated by reflection and refraction, while high frequency, low amplitude waves are expanded and neutralized by modulation and intermediate frequency waves are concentrated and dispersed.

The muffler 20 includes a housing 22 having a central portion 24 and generally conical upstream and downstream end portions or caps 26 and 28, respectively. As illustrated, the housing 22 is cast or injection molded, preferably of a light weight, non-ferrous material such as aluminum. A number of narrow, circumferentially spaced, longitudinal cooling fins 30, projecting radially outwardly from the central housing portion 24, may be provided for heat dissipation. A number of corresponding fins 32 and 34 may be provided on the upstream and downstream housing end portions 26 and 28, respectively.

With such cast or molded housing construction, provision is made for connecting the muffler 20 to an upstream exhaust duct or pipe 36, for example, by bolting a flanged portion 38 of such duct to the upstream housing end portion 26 by a plurality of bolts 40. Similarly, provision is made for bolting a flange 42 of a downstream exhaust duct or pipe 44 to the downstream housing end portion 28 by a plurality of bolts 46. Upon assembly of the muffler 20, the housing end portions 26 and 28 are welded to the central portion 24 to provide a gas-tight structure. The central portion 24 may be of circular cross section, as shown, or may be of oval, elliptical or other desired cross-sectional shape.

Alternatively, the housing 22 may be formed to the general shape illustrated but without the cooling fins, from thin, corrosion resistant sheet metal, such as stainless steel. In such case, short upstream and downstream exhaust ducts, similar to the ducts 36 and 44 shown, may be formed integrally with the muffler.

Internally, the muffler 20 is longitudinally divided into three major chambers: a first, upstream chamber 50; a second, central chamber 52 and a third, downstream chamber 54. Such division is provided by a first transverse wall partition or closed-off dispersion baffle 56 and a second transverse wall partition 58 which, as illustrated in FIGS. 1 and 2, comprises an upstream wall member or seal 60 and a closely spaced downstream wall member or seal 62. The first transverse wall partition 56 is disposed within the central housing portion 24 about a quarter of the muffler length downstream from the upstream end portion 26; the second transverse wall partition is generally centrally disposed with the central housing portion. A third transverse wall partition 64 is disposed within the first chamber 50 near and upstream of the wall portion 56, thereby forming a small fourth chamber 66 between the first and second chambers 50 and 52.

The partitions 56 and 64, as well as the wall members 60 and 62 are constructed of a thin, corrosion resistant sheet metal such as stainless steel, and each may include lateral stiffening ribs 68 to increase their rigidity. Upstream central portions of the partitions 56 and 64 as well as of the upstream wall member 60 may be formed convex in an upstream direction (in a manner not shown) to provide added stiffening and sound wave dispersion. When employed with a non-ferrous cast or molded housing 22, the partitions 56 and 64 and wall members 60 and 62 are not connected at their peripheries to the central housing portion 24 but are merely retained in closely fitting relationship by other internal components, as more particularly described below. The wall members 60 and 62, which define a small chamber 70 therebetween, form a labyrinth seal to prevent noise transmission between the second and third chambers 52 and 54, respectively. When, however, the housing 20 is formed of sheet metal, the upstream wall member 60 may be omitted and the partitions 56 and 64, as well as the wall member 62, may be formed having peripheral flanges which are welded or interference fitted to the central housing portion 24 upon assembly.

Leading into the first, upstream chamber 50 is an exhaust inlet or entrance duct 72 which axially extends into such chamber to within about one inlet duct diameter from the partition 64.

Installed through flanged apertures formed in partition 56, 64 and wall members 60, 62 in a symmetrical, laterally spaced manner on a cross section center line are two similar, parallel and elongate, internal flow modulation ducts 74, the ducts being essentially cylindrical and being, for example, welded to flanges 78, 80, 82 and 84 formed, respectively, around duct receiving apertures through the partitions 64 and 56 and the wall members 60 and 62. Although two internal ducts 74 are shown and described, other numbers of ducts may be used; only one is required and more than two may be used, the general requirement being that the ducts be out of alignment with the inlet duct 72 and an exhaust outlet duct 76 (described below) and be symmetrically arranged (if more than one is used).

Open upstream ends 86 of the ducts 74 project upstream of the partition 64 into the first chamber 50 a distance equal to about 2½ to 4 duct diameters, and extend upstream a short distance beyond an open downstream end 88 of the inlet duct 72. The duct ends 86 are also preferably spaced at least 1 duct diameter from the nearest inner portions of the upstream end portion 26. Open downstream ends 90 of the internal ducts 74 extend a short distance beyond the wall member 62 and into the third chamber 54. The ducts 74 thus project entirely through the second and fourth chambers 52 and 66.

Formed in an opposite side of each of the internal ducts 74, within the fourth chamber 66, is a large rectangular opening or aperture 92, such opening having approximately the same area as the cross sectional area of the associated internal duct. The openings 92 are directed generally tangentially towards adjacent inside surfaces of the central housing portion 24, and are also directed in the same general circular direction (FIG. 1).

Figure 4:
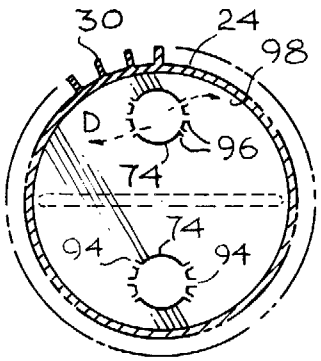
FIG. 4 is a sectional view taken along line 4—4 of FIG. 1, showing the arrangement of the internal ducts thereof.

The internal ducts 74 are formed, in the region of the second chamber 52, to have a number of small diameter formed openings or apertures 94. In forming the openings 94, wall portions of the ducts 74 are punched or expanded outwardly, thereby forming short, tubular aperture-defining projections or nozzles 96 having a length about equal to the diameter of the openings. These tubular projections 96 are essentially formed in longitudinal rows and, as seen in FIG. 4, these rows are formed at opposite sides of the ducts 74, three rows, each having tubular nozzle projections 96, preferably being formed on opposite sides of each duct. The ducts 74 are oriented so that the tubular nozzle projections 96 are generally perpendicular to a plane through the longitudinal axes of the two ducts; that is, the two sets of three rows of each duct are directed oppositely to each other, and generally parallel to the adjacent inside surface 98 (FIG. 4) of the housing portion 24. The tubular nozzle projections 96 in the ducts 74 preferably start about 3 to 5 internal duct diameters downstream of the upstream duct openings 86.

Figure 5:
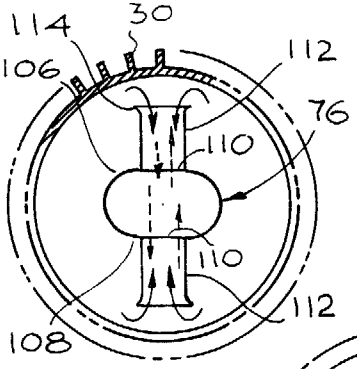
FIG. 5 is a sectional view taken along line 5—5 of FIG. 2, showing the exhaust outlet duct and short tubes connected thereto.

Projecting inwardly into the third chamber 54 from the downstream end of the housing 22 is the exhaust outlet duct 76 which is long and tubular. As seen in FIG. 1, an upstream end 102 of the duct 76 extends to the downstream side of the second wall member 62, and is connected, as by welding, to a downstream directed projection 104 thereof for support; the duct 76 does not communicate through the wall member 62 into the chamber 70. As shown in FIG. 5, the duct 76 is formed having major portions within the third chamber 54 of generally oval or elliptical cross section but is generally cylindrical where it exits the housing 22.

Formed in opposite wide, flat side portions 106 and 108 of the exhaust outlet duct 76 are a plurality of inlet openings or apertures 110 (six being shown—three on each side), the apertures on opposite sides being in opposing relationship (FIGS. 2 and 5). Connected to the duct 76 at each of the apertures 110 is an outwardly directed, open short tube or pintle 112, the longitudinal axes of opposite tubes being aligned. Preferably, outer tube ends 114 are radially flared to a slightly increased inlet diameter. When such flaring is employed, the ratio of the tube length to the tube diameter is preferably equal to or less than about 2½ to one. Alternatively, the tubes 112 may be unflared, in which case the length-to-diameter ratio is preferably in the range of about 2½ – 3 to 1. The longitudinal axes of the tubes 112 lie in a common plane at right angles to the plane through the longitudinal axes of the internal ducts 74; that is, the tube inlet ends 114 are positioned to about 90° out of alignment with the downstream ends 90 of the internal ducts. The farthest upstream inlets 114 of the tubes 112 are downstream from the downstream ends 90 of the internal ducts 74.

It is to be appreciated that when a cast or molded housing 22 is employed, the core portion may be separately assembled and then installed merely by press sliding the core assembly into the central housing portion 24 before one or both housing end portions 26 and 28 are welded thereto.

Theory of Operation

Exhaust gases from automobiles, motorcycles, boats and other applications utilizing internal combustion engines contain a wide spectrum of vibratory pressure waves which are characterized generally as "noise". This noise comprises a complex interaction of pressure waves generated and influenced by the primary noise source (the engine), valve timing, porting configuration and the geometry of manifolding exhaust ducts to result principally in first and second harmonics superimposed upon primary and secondary pressure waves. These pressure waves are affected by the geometry of a silencing apparatus, or muffler, which establishes and promotes radial and longitudinal modes of pressure wave reinforcement and propagation.

In FIGS. 1 and 2, the direction of flow of exhaust gases is illustrated by solid arrows and the general direction of sound or pressure wave propagation is illustrated by broken line arrows.

In the preferred embodiment as above-described, exhaust gases from an outlet portion of an internal combustion engine (not shown) are routed to the muffler 20 by the exhaust inlet duct 72. Within the first chamber 50, the gases are dispersed radially outwardly to the inside of the housing 22 by the transverse wall partition 64 against which the incoming gases impinge; the radially directed gases are then deflected or recirculated upstream to an inner surface 120 of the upstream housing end portion 26, where initial separation of the pressure waves and gas flow occurs. The circulation of the gases in the chamber 50 is in the general direction of the solid arrows A. The exhaust gases, treated as a physical entity, enter the internal ducts 74 through the upstream openings 86, which are preferably rounded and free of burrs which could cause high frequency, low amplitude pressure waves, whereas the pressure waves, being vibratory elements, are conveyed along the housing end portion inner surface 120, concentrated on the outer periphery of the exhaust inlet duct 72 and travel therealong downstream to interact and establish dissonant frequencies with incoming gas pressure waves. Although the propagation of pressure waves in chamber 50 is complex, it can generally be represented by the broken line arrows B. The interaction of these pressure waves with the incoming gas pressure waves creates a dephasing action. Pressure waves, and to a lesser extent the exhaust gases, continue to recirculate within the first chamber 50, yielding pressure wave gradients as interaction among the circulating, mixed pressure waves continues. The result is creation of a multiplicity of pressure waves of lower amplitude and random nature reflecting within the chamber 50.

The pressure wave front of a compressible gas in a duct is characterized by a paraboloid or parabola of revolution. In a smooth enclosed duct, the geometry of the parabola is primarily governed by fluid density, velocity of the gas and wall configuration. In the internal ducts 74, the openings 92 into the fourth chamber 66 are, as previously described, located about 3–5 duct diameters downstream of the upstream duct ends 86, so that the exhaust gases will, by the time they reach the openings 92, have reestablished the rudiments of laminar flow and a boundary layer will have attached to the internal surfaces of such internal ducts. The parabolic pressure front in the ducts 74 may best be described as a pulsating pressure front dependent upon characteristics of the excitation forces as influenced by upstream manifolding, exhaust valve characteristics, frequency of the excitation force, etc. A sudden relief in this parabolic pressure front, as provided by the duct openings 92, introduces near collapse in the focus-vertex points on the pressure front and results in a radial pressure wave vector into the chamber 66.

Pressure wave gradients readily enter the fourth chamber 66 through the internal duct openings 92 (as shown by broken line arrows C) but are inhibited from re-entering the ducts from that chamber due to the direction of pressure wave propagation. The tangential pressure waves thus created in the chamber 66 are dissipated by chamber boundary layer effects and interaction with incoming pressure waves. The gas flow through the internal ducts 74 is only momentarily interrupted at the openings 92. Since this radial expansion is particularly effective in the low frequency, high amplitude noise range, use of such openings 92 is particularly adaptable for motorcycle engines, two cycle internal combustion engines, and engines having only one or two cylinders, all of which exhibit high amplitude, low frequency noise.

Pressure waves downstream of the openings 92 continue through the ducts 74, noise frequencies in the intermediate frequency range being permitted to propagate through the small tubular nozzle projections 96 from the ducts radially outwardly into the second chamber 52 (in the direction of broken line arrows D). Entrances of the tubular nozzle projections 96 are constructed to enhance, accelerate, and encourage the development of tangential pressure wave propagation and attenuation into the chamber 52 and inhibit the return of such pressure waves back into the ducts 74. Exit ends of the tubular projections 96 are constructed to severely inhibit reentry of pressure waves, but to permit "breathing" of gases between the second chamber 52 and the ducts 74.

The downstream end of the second chamber 52 is sealed as above-described, for a non-ferrous cast or molded housing 22, by a labyrinth seal arrangement comprising the spaced wall members 60 and 62, the small enclosed space 70 being thereby provided. This type of seal is effective for preventing noise passage from the second chamber 52 into the third chamber 54, while allowing construction of a muffler 20 without the usual bond between the downstream wall member 62 and the central housing portion 24. As noted, however, this seal arrangement is not required when the periphery of the wall member 62 is welded or press fitted to the housing, in which case the upstream wall member 60 may be eliminated.

In the third chamber 54 located downstream of the second transverse wall partition 58, the exhaust gases are substantially stagnated. Within the chamber 54, residual noise waves escaping upstream modulation and attenuation are directed downstream (in the direction of broken line arrows E) toward an inner surface 122 of the downstream housing end portion 28, the pressure waves being thereby reflected (in the direction of broken line arrows F) and concentrated toward the center of the chamber away from the entrance ends 114 of the exhaust outlet duct tubes 112 which are positioned upstream of central portions of such chamber. The 30° to 60° angle of taper of the housing end portion 28 causes effective reflection and concentration of the pressure waves and inhibits formation of reverberation/reinforcement random pressure waves. The volume of the third chamber 54 is relatively noncritical, being controlled by space requirements and necessary spacing for the short tubes 112 connected to the exhaust outlet duct 76.

The length-to-diameter ratios of the tubes 112—preferably in the range of 2½ – 3 to 1 for non-flared tubes and about 2½ or less to 1 for flared tubes—establishes low velocity, laminar gas flow within the tubes prior to gas flow entry into the outlet duct 76. Since noise or pressure waves have a tendency to travel in a three-dimensional, expanding parabolic pressure wave from the emitting source, the opposing relationship of the exhaust outlet duct tubes 112 causes inflowing exhaust gases (solid arrows G) from opposing tubes to meet in a dynamic gas front within the exhaust outlet duct and directs out-of-phase, residual pressure waves across the outlet duct and into opposing tubes 112 and thence back out into the third chamber (broken line arrows H). The number of tubes 112 (six having been illustrated) is determined by the length-to-diameter ratio and by the afore-mentioned laminar flow requirements, it being preferable to have about one tube 112 diameter clearance between the outer ends of the tubes 112 and the inside of the central housing portion 24.

As described above, the exhaust outlet duct 76 has a flattened, oval or elliptical cross section in the region of the tubes 112, the distance between opposing duct sides 106 and 108 from which the tubes 112 project being such as to permit pressure wave transfer from opposing tubes with maximum efficiency, and the shape being such as to provide the desired clearance for gas flow around successive pintle tube outlet openings 110. The oval or elliptical duct cross section thus permits exhaust gases entering the duct from upstream tubes 112 to diffuse around or bypass further downstream tube openings 110, thereby preventing noise being created by turbulent gas interactions at downstream tube openings, such as would occur if means for gas bypass were not provided. In addition, the oval or elliptical cross section of the exhaust outlet duct 76 also provides for smooth realignment of gas into a substantially laminar flow for exhausting therefrom at the downstream end.

The above-mentioned muffler 20 configuration and construction results in a compact, highly efficient muffler approximately only one-third to one-half the volumetric size of other mufflers on the market having comparable noise suppression and performance characteristics.

Variation of FIGS. 6–9

A variation, generally similar to the above-described muffler, except as distinguished below, is illustrated in FIGS. 6–9. Parts and features identical to those previously described are given identical reference numbers; other parts and features corresponding generally to (not identical to) above-described parts and features are given the identical reference number followed by the letter *a*; new or added parts and features are given reference numbers starting with the number 200.

Figure 6:
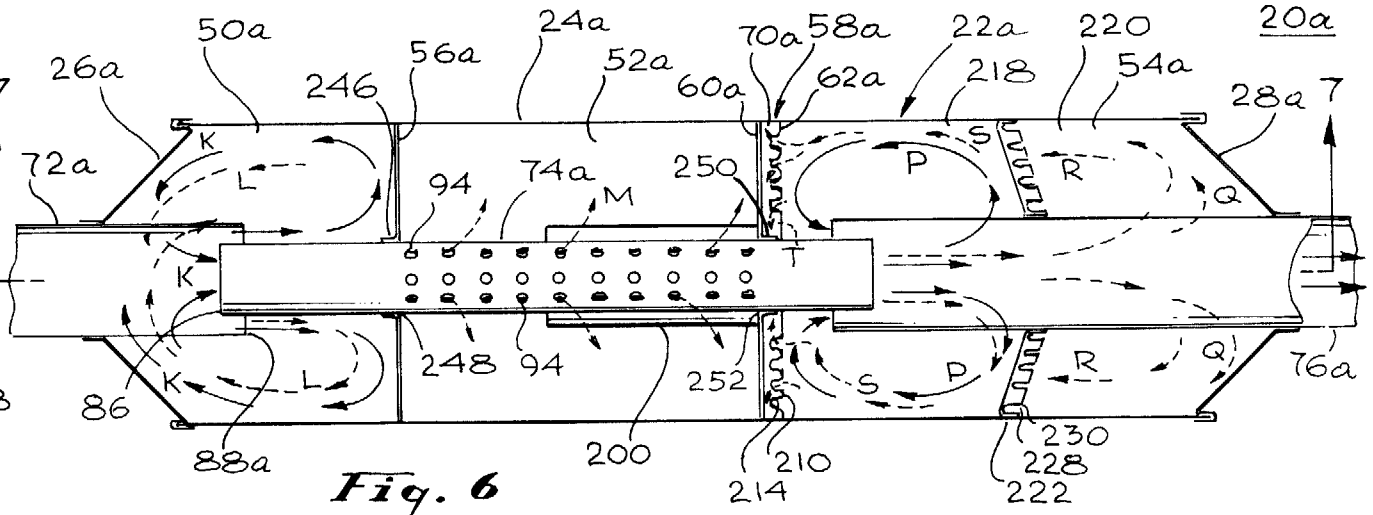
FIG. 6 is a plan view, in section, of another arrangement in accordance with the invention.
Figure 7:
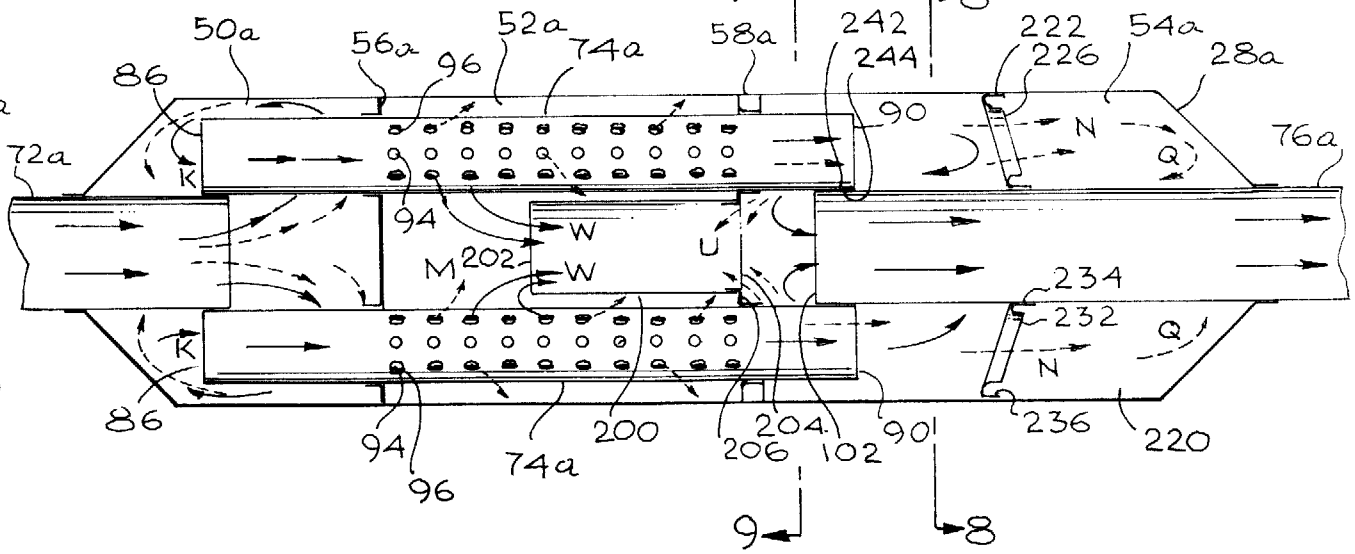
FIG. 7 is a side elevational view, in section, taken along line 7—7 of the arrangement of FIG. 6.

As seen in FIGS. 6 and 7, a muffler **20*a* includes a housing 22*a* having a central portion 24*a*, an upstream housing end portion 26***a* and a downstream housing end portion 28*a*, the housing differing from that previously described by being formed, as by welding, of corrosion resistant sheet metal, rather than being cast or molded from a non-ferrous metal. However, such type construction may alternatively be used. The housing 22*a* is internally, longitudinally divided into first, second and third chambers 50*a*, 52*a* and 54*a* by first and second transverse wall partitions 56*a* and 58*a*, respectively.

An axially disposed exhaust gas inlet duct 72*a* conducts exhaust gases from an upstream exhaust duct (not shown) into the first chamber 50*a* through the upstream housing end portion 26*a*, to which such duct is joined, as by welding. An exhaust outlet duct 76*a*, axially disposed through and welded to the downstream housing end portion 28*a*, projects upstream well into the third chamber 54*a*. A pair of cylindrical, internal ducts (or gas flow modulation ducts) project through the wall partitions 56*a* and 58*a*, upstream ends 86 thereof extending upstream into the first chamber 50*a* and terminating upstream of a downstream end 88*a* of the exhaust inlet duct 72*a*. The upstream duct ends 86 are positioned in the range of about 2½ to 4 duct diameters upstream of the partition 56*a*, and at least about one duct diameter away from the closest portions of the housing end portion 26*a*. Downstream ends 90 of the internal ducts 74*a* extend downstream into the third chamber 54*a* beyond an upstream end 102 of the exhaust outlet duct 76*a*. Three rows of openings 94 are formed along opposite sides of the internal ducts 74*a* in the region of the second chamber 52*a* and starting about 3–5 duct diameters downstream of the upstream duct ends 86. Portions of such ducts 74*a* are expanded outwardly in the region of the apertures 94 to form short tubular-opening-defining outwardly projections or tubes 96. The arrangements of the rows of projections 96 is as above-described.

The second transverse wall portion 58*a*, includes an upstream wall member 60*a* and a downstream wall member (or reverberation buffer panel) 62*a*, the members being spaced closely together along the longitudinal axis of the housing 22*a* to form an axially short neutralizatiion chamber 70*a* therebetween.

As best seen in FIG. 7, an elongate tubular and cylindrical resonator 200, open at an upstream end 202 and at downstream end 204, is joined at the downstream end, as by welding, to an upstream directed flange 206 centrally formed on the downstream wall member 62*a* around an opening 204. The resonator extends upstream about one-half to two-thirds of the way through the second chamber 52*a*, and provides communication between the second and third chambers 52*a* and 54 *a*. The diameter of the resonator 200 is somewhat larger than the diameter of the internal ducts 74*a* and the opening 204, and hence the inside cross section of the resonator, has an area equal to about 75–80percent of the cross-sectional area of the outlet duct 76*a*.

Figure 9:
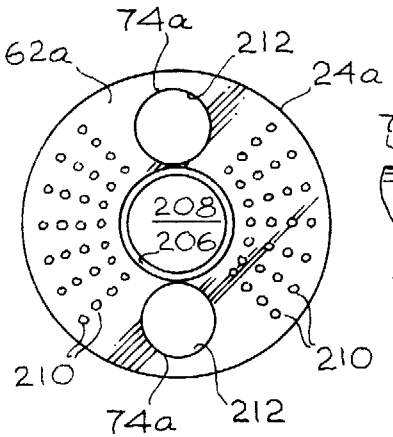
FIG. 9 is a sectional view taken along line 9—9 of FIG. 7.

In the downstream wall member 62*a*, as seen in FIGS. 6 and 9, a comparatively large number (56 being shown) of small diameter apertures 210 are formed, the apertures being symmetrically formed in regions of the wall 62*a* intermediate diametrically opposed openings 212 (FIG. 9) formed therein for receiving the internal ducts 74*a*. The apertures 210 are essentially equally spaced along radial lines, four of such apertures being illustrated on radial lines. The quantity of apertures required is dependent on muffler application and tuning desired. The sheet metal material of the wall 62*a* is expanded or punched outwardly in an upstream direction in the region of each apertures 210, thereby forming tubular-aperture-defining projections 214 (FIG. 6) having a length about equal to the diameter of the defined apertures 210.

Dividing the third chamber 54*a* into an upstream acoustical sub-chamber 218 and a downstream stagnation sub-chamber 220, each of approximately the same volume, is a transverse diffusion and expansion buffer panel 222 having formed centrally therein an opening 224 through which the exhaust outlet duct 76*a* passes, the duct projecting entirely through the downstream sub-chamber and into the upstream sub-chamber. The length of the third chamber 54*a* is such that the generally centrally located buffer panel 222 is in the range of about 2½ to 3 internal duct 74*a* diameters downstream from the downstream duct ends 90.

Figure 8:
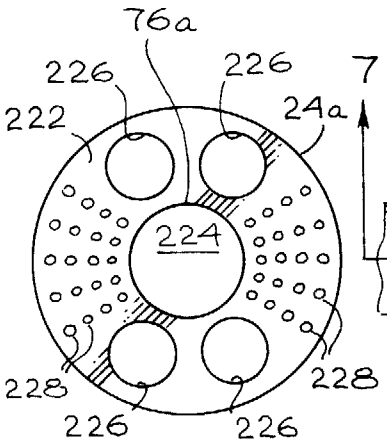
FIG. 8 is a sectional view taken along line 8—8 of FIG. 7.

The buffer panel 222, as best seen in FIGS. 6 and 7, is formed of sheet metal in a generally frusto-conical, or dished shape, the angle which sides of the panel make with a transverse plane through the muffler 20*a* being about 30° and the apex thereof being directed downstream. Formed in the panel 222, as seen in FIG. 8, are four large openings or apertures 226 having substantially the same diameter as the internal ducts 74*a*. The openings 226 are formed in a symmetrical manner, two above and two below the central aperture 224, each opening being at the same radial distance from the center of the panel 222 and the openings of each pair being spaced comparatively close together. Upon assembly, the panel 222 is oriented so that the narrow region between each pair of openings 226 is substantially aligned with the downstream ends 90 of the internal ducts 74*a*.

In side panel regions between the pairs of openings 226 are formed a number (approximately 40 being shown) of small apertures 228, such apertures being substantially the same diameter as the apertures 210 in the downstream wall member 62*a* and being symmetrically arranged in about 10 radial rows of about four apertures each. In forming the apertures 228, the panel 222, which is of sheet metal construction, is expanded or punched outwardly in a downstream direction to form short aperture-defining projections or tubes 230 (FIG. 6) similar to the above-described aperture-defining projections 214.

When forming the openings 226 in the panel 222, the panel is also expanded in the downstream direction to form a flange 232 around each such aperture (FIG. 7). Similarly, a downstream directed flange 234 is formed around the central opening 224, the outlet duct 76*a* as by welding to such flange. To provide for attaching the panel 222 to the central housing portion 24*a*, a downstream directed flange 236 is formed around the periphery of the panel (FIGS. 6 and 7).

As illustrated in FIG. 7, the open upstream end 102 of the exhaust outlet duct 76*a* extends upstream a short distance beyond the downstream end 90 of the internal ducts 74*a*. The internal ducts 74*a* and the exhaust outlet duct 76*a* are arranged so that in this overlapping region,, side portions 242 of the ducts 74 are in contact with side portions 244 of the ducts 76*a* and are then joined, preferably by welding, to provide a strong rigid internal structure or core. Upon assembly, the internal ducts 74*a* are joined, as by welding, to flanges 246 formed around duct receiving apertures 248 in the partition 56*a* and to flanges 250 formed around duct receiving apertures 252 formed in the upstream wall member 60*a*.

Operation of the Variation of FIGS. 6–9

In the variation of FIGS. 6–9, exhaust gases are directed through a duct (not shown) to the muffler 20*a* and through the exhaust inlet duct 72*a* into the first chamber 50*a*. Again, the general direction of gas flow is indicated in FIGS. 6 and 7 by solid arrows, and the general direction of pressure wave propagation is indicated by broken line arrows. Within such chamber, exhaust gases are radialy directed and dispersed by the transverse partition 56*a* to the inside of the central housing portion 24*a*. The gases are then deflected upstream to the upstream end portion 26*a*, being thereby caused to circulate past upstream ends 86 of the internal ducts 74*a* (direction of solid arrows K) where the initial separation of pressure waves from the exhaust gases occurs. The pressure waves continue to circulate around the outer periphery of the exhaust inlet duct 72*a*, thereby interacting with the incoming pressure waves to set up dissonant frequencies (direction of broken line arrows L).

The conical shape of the upstream housing end portion 26*a* and the spacing of the internal duct upstream ends 86 away from such end portion enhances pressure wave flow past the ducts 74*a* and causes them to be concentrated on the inlet duct 72*a* downstream towards the partition 56*a* where interaction with incoming pressure waves occurs to initiate pressure wave dephasing. Dephasing in the first chamber 50*a* creates a multiplicity of small, interacted pressure waves of first, second and third degree harmonics.

The exhaust gases then enter the upstream ends 86 of the internal ducts 74*a*, such ends being rounded and free of burrs which could cause high frequency, low amplitude pressure waves. Within the internal ducts 74*a*, because the apertures 94 therein are located three to five duct diameters downstream from the upstream duct ends 86, the gas flow pattern will have established the rudiments of laminar flow and a boundary layer will have attached to the inside walls of the ducts. With the establishment of such laminar flow, a defined three-dimensional parabolic pressure front is assured. The tubular projections 96 (defining the apertures 94) which are located within the central chamber 52*a*, permit periodic radial and tangential expansion and disruption of the parabolic wave front without inducing high frequency, low amplitude pressure waves, which allow radial gas acceleration and expansion into chamber 52*a*. The numerous small tubular projections 96 acting as a multitude of expansion nozzles are particularly effective in accelerating radially displaced pressure waves and gas flow (in the direction of broken line arrows M) in the high frequency, low amplitude range wherein the rapid gas acceleration effectively collapses the pressure waves into chamber 52*a*, resulting in essentially a gas stagnation condition within chamber 52*a*.

The large openings 226 in the panel 222 allow pressure waves emitted from the downstream ends 90 of the internal ducts 74*a* to efficiently pass through such panel (broken line arrows N); however, the exhaust gas flow is dynamically repulsed with a high degree of efficiency to circulate back upstream (in the direction of solid arrows P). The pressure wave front continues into the stagnation sub-chamber 220 (direction of broken line arrows Q) and are reflected upstream (direction of broken line arrows R, FIG. 6) along inner surfaces of a downstream housing end 28*a* to concentrate and interact in the central portion of sub-chamber 220, where they reverberate to a negligible level due to pressure wave interaction and boundary layer effects within the sub-chamber. Such configuration is effective for neutralization of low frequency, high amplitude pressure waves. The small tubular projections 230 formed around panel apertures 228 diffuse and decouple wave reflections within the chamber 220 and, due to their configuration, function with high efficiency as a one-way pressure wave valve.

Pressure waves that may escape from the openings 226 in the panel 222, due to low gas velocities, are reflected within the sub-chamber 218 (direction of broken line arrows S, FIG. 6) and are efficiently dephased by the tubular elements 214 (which allow some portions of the pressure waves to enter the other sub-chamber 70*a*). The small tubular projections 214 formed in the wall member 62*a* upstream of the diffusion panel 222 permit passage into the chamber 70*a* (broken line arrows T, FIG. 6) of residual random pressure waves that may be present in the sub-chamber 218 due to wave reflection, reverberation or dispersion. Such transient pressure waves passing through these tubular elements 212 are "neutralized" in the chamber 70*a*.

The configuration of the resonator duct 200, which extends openly from the second transverse partition 58*a* upstream into the central chamber 52*a*, is effective in modulating reinforced pressure waves of a random nature (travelling in the direction of broken line arrows U, FIG. 7), such as may occur during engine idling or engine roughness operation, and in establishing a more pleasant resonant sound to the exhaust gases.

During operation, a controlled bypass of exhaust gases into the central chamber 52*a* is permitted through the tubular elements 96 formed in the internal ducts 74*a* (solid arrows W). Such "bypass" gases flow out through the resonator duct 200 to the exhaust gas outlet duct 100*a*, such flow preferably comprising only about 10 to 15 percent of the total exhaust gas flow through the muffler, and to ensure essentially a stagnation condition in chamber 52*a*.

In this variation, intermediate pressure waves are removed from the gas flow stream by the wall members 62*a* and the baffle 222, which cause non-reversible pressure wave flow reflection and refraction, and by the neutralization chamber 70*a*. Residual random pressure waves are neutralized by the combined gas interaction of resonator duct 200 and exhaust duct 76*a*.

In the above-described manners, significant improvement in muffler performance with very low back pressure, over the full range of audible frequencies, is achieved in a simple, compact muffler of only one-third to one-half the volume of equivalent mufflers, such compact muffler being also of comparatively simple construction and utilizing comparatively open and direct gas flow paths.

Although there have been described specific arrangements of engine muffler apparatus in accordance with the invention for the purpose of illustrating the manner in which the invention may be used to advantage, it will be appreciated that the invention is not limited thereto. Accordingly any and all modifications, variations or equivalent arrangements which may occur to those skilled in the art should be considered to be within the scope of the invention as defined in the appended claims.

What is claimed is:

1. An exhaust muffler apparatus for internal combustion engines and the like, which comprises:

a. an elongate, tubular housing having a central portion and upstream and downstream end portions, b. first and second transverse wall means for internally dividing the housing longitudinally into a first upstream chamber, a second central chamber and a third downstream chamber;

c. an exhaust inlet duct extending through the upstream housing end portion into the first chamber, the duct having open upstream and downstream end portions.

d. an exhaust outlet duct extending through the downstream end portion into the third chamber, the outlet duct having an open downstream end portion and having at leasst one inlet opening formed in an upstream portion thereof disposed in the third chamber; and e. at least one elongate, internal duct longitudinally disposed within the housing, the internal duct being laterally displaced out of alignment with the inlet and outlet ducts and being open at both ends and extending through the first and second wall means into the first and third chambers and entirely through the second chamber, the upsteam end of the internal duct being positioned upstream of the downstream end of the exhaust inlet duct and the downstream end of the internal duct being positioned downstream from the upstream end of the exhaust outlet duct, the internal duct including means defining a number of expansion nozzle apertures in the portion of the duct disposed within the second chamber.

2. The apparatus according to claim 1, wherein the nozzle aperture defining means defines at least two longitudinal rows of spaced apertures on the internal ducts, said rows being arranged so that at least one row is along one side of the internal duct and at least another row is on a diametrically opposite side of the same duct, said rows of apertures extending substantially the entire length of the duct portion within the second chamber.

3. The apparatus according to claim 2, including two internal ducts, each positioned in proximity to said housing diametrically opposite the other, the rows of expansion nozzle apertures in the ducts being directed generally perpendicular to the plane through the longitudinal axes of the two ducts.

4. The apparatus according to claim 1, wherein the aperture defining means includes outwardly expanded portions of the internal ducts forming short, tubular aperture-defining elements.

5. The apparatus according to claim 1, wherein the housing end portions are formed in generally frustoconical shape, the apex of the upstream housing end portion being directed upstream and the apex of the downstream housing end portion being directed downstream.

6. The apparatus according to claim 5, wherein the conical angle of the housing end portions is approximately the same and is in the approximate range of 30° to 60° from the longitudinal axis of the housing.

7. The apparatus according to claim 1, wherein the housing is formed having a plurality of longitudinal, circumferentially spaced and radially outwardly projecting cooling fins, the housing ends being also formed having a plurality of radial, outwardly projecting cooling fins.

8. The apparatus according to claim 1, wherein the second transverse wall means comprises upstream and downstream transverse wall members spaced in close longitudinal relationship along the housing, thereby defining a small chamber therebetween, the upstream end of the exhaust outlet duct being connected to a downstream surface of the downstream wall member without communicating therethrough.

9. The apparatus according to claim 1, wherein the exhaust outlet duct, in the region of the third chamber, includes means defining at least one pair of openings in opposing relationship on opposite sides thereof, through which exhaust gases from the internal ducts are admitted into the exhaust outlet duct.

10. The apparatus according to claim 9, wherein the outlet duct opening defining means includes a short tube projecting radially outwardly from the exhaust outlet duct at each defined opening, outer ends of the tubes being spaced substantially away from inner surfaces of the housing, said tubes on opposite sides of the exhaust outlet duct being arranged in opposition by pairs.

11. The apparatus according to claim 10, wherein the outlet exhaust duct is oriented so that the outer ends of the short tubes projecting therefrom are out of alignment with the downstream end of the internal duct, said internal duct downstream end terminating upstream from the furthest upstream of said tubes.

12. The apparatus according to claim 10, wherein the short tubes projecting from the exhaust outlet duct are of constant diameter, the ratio of the tube length to the tube diameter being in the range of about 2½ to 3.

13. The apparatus according to claim 10, wherein the ends of the short tubes projecting from the exhaust outlet duct are flared outwardly to a larger opening diameter, the ratio of tube length to the tube diameter, in regions other than the flared region, being less than about 2½.

14. The apparatus according to claim 11, wherein the exhaust outlet duct is of generally oval cross section, said duct opening defining means being disposed at opposing outlet duct sides which are closest together.

15. The apparatus according to claim 1, further including third transverse wall means disposed in the first chamber downstream of the downstream end of the exhaust inlet duct, said first and third wall means defining a fourth chamber between the first and third wall means.

16. The apparatus according to claim 15, including means for defining a side opening in a portion of each internal duct disposed within said fourth chamber, said opening having substantially the same area as the cross-sectional area of the internal duct.

17. The apparatus according to claim 16, wherein each side opening is directed tangentially toward an adjacent inside portion of the housing, each side opening being directed in the same general circumferential direction.

18. The apparatus according to claim 16 wherein the internal ducts are circular in cross section and wherein each side opening is located in the range of about 3–5 internal duct diameters downstream from the upstream end of the associated internal duct.

19. The apparatus according to claim 15,, wherein the internal ducts are circular in cross section and wherein the upstream ends of the internal ducts are positioned to be in the range of about 2½ to 4 internal duct diameters upstream of said third wall means, the internal ducts and the housing being formed so that the upstream ends of the internal ducts are also at least about one duct diameter downstream of the closest portions of the upstream end portion of the housing.

20. The apparatus according to claim 1, wherein the second transverse wall means includes upstream and downstream transverse wall members, spaced in close longitudinal relationship along said housing to define a small chamber therebetween, and further including a resonator tube disposed through said upstream and downstream transverse wall members and affixed thereto, said resonator tube having an open downstream end relatively adjacent the downstream side of the downstream wall and in communication with the third chamber, the resonator tube projecting upstream into the second chamber, both ends thereof being open to provide communication between the second and third chambers through the resonator tube.

21. The apparatus according to claim 20,, wherein the downstream transverse wall member includes means defining a plurality of openings into said small chamber.

22. The apparatus according to claim 21, wherein the means defining openings in the downstream wall member includes a plurality of short tubular elements, the length of the tubular elements being substantially equal to the diameter of the openings therein, said openings being substantially smaller than the diameter of the internal ducts.

23. The apparatus according to claim 20 further including a transverse sound diffusion panel disposed within the third chamber downstream of both the downstream ends of the internal ducts and the upstream end of the exhaust outlet duct, said sound diffusion panel dividing the third chamber into upstream and downstream sub-chambers of approximately equal volume.

24. The apparatus as claimed in claim 23, wherein the internal ducts are circular in cross section and wherein the diffusion panel is positioned to be spaced downstream from the downstream ends of the internal ducts a distance in the range of about 2½ to 3 internal duct diameters.

25. The apparatus according to claim 23, wherein the sound diffusion panel includes means defining a plurality of first openings therethrough which are substantially the same diameter as the internal ducts.

26. The apparatus according to claim 25, wherein the sound diffusion panel further includes means defining a plurality of second openings through the panel which are substantially smaller in diameter than the diameter of the internal ducts and are disposed in a symmetrical manner.

27. The apparatus according to claim 26, wherein the means defining the plurality of second openings includes tubular nozzle projections defining the second openings, said tubular nozzle projections being directed in a generally downstream direction from the panel.

28. The apparatus according to claim 23, wherein the sound diffusion panel is formed in generally frustoconical shape, the apex thereof being directed generally downstream and having a flange attached about the exhaust outlet duct.

* * * * *